US010912353B2

(12) United States Patent
Noel

(10) Patent No.: US 10,912,353 B2
(45) Date of Patent: Feb. 9, 2021

(54) NECKLACE WITH INTERCHANGEABLE JEWEL PART

(71) Applicant: Charise Noel, San Marcos, CA (US)

(72) Inventor: Charise Noel, San Marcos, CA (US)

( * ) Notice: Subject to any disclaimer, the term of this patent is extended or adjusted under 35 U.S.C. 154(b) by 0 days.

(21) Appl. No.: 16/131,846

(22) Filed: Sep. 14, 2018

(65) Prior Publication Data

US 2020/0085155 A1 Mar. 19, 2020

(51) Int. Cl.

*A44C 15/00* (2006.01)
*A44C 7/00* (2006.01)
*A44C 13/00* (2006.01)

(52) U.S. Cl.

CPC ..... *A44C 15/0025* (2013.01); *A44C 7/002* (2013.01); *A44C 15/005* (2013.01); *A44D 2203/00* (2013.01)

(58) Field of Classification Search

CPC ..... A44C 13/00; A44C 5/20; A44C 5/2071; A44C 5/2076; A44C 5/2085; A44C 15/0025; A44C 7/002; A44C 15/005; A44B 11/258; A44B 11/2584; A44B 11/2592; A44D 2203/00

See application file for complete search history.

(56) References Cited

U.S. PATENT DOCUMENTS 1,853,387 A * 4/1932 Vetter ..... A44C 5/2038 24/600.9
2,659,169 A 11/1953 Brennan
2,752,764 A 7/1956 Lederer
3,129,477 A 4/1964 Mizuno
4,959,890 A 10/1990 Pazurek
6,594,871 B2 7/2003 Hoffman
7,201,021 B2 4/2007 Hartgrove
8,640,266 B2 * 2/2014 Best ..... A44C 15/003 2/104
10,376,022 B2 * 8/2019 Duncan ..... H01F 7/0263
2006/0123845 A1 6/2006 Beard
2006/0174649 A1 8/2006 Azrielant
2009/0013720 A1 1/2009 Altick
2010/0101374 A1 4/2010 Hahn et al.
2013/0263625 A1 10/2013 Taylor-Cattapan

* cited by examiner

*Primary Examiner* — Jack W Lavinder

(74) *Attorney, Agent, or Firm* — Law Office of Scott C Harris, Inc

(57) ABSTRACT

A magnetic jewelry piece that is formed of first and second pieces that hold together to hold the necklace in a first configuration where there is only a single ornament that is showing, or can be separated, such that each of the first and second pieces get their own ornaments. The magnetic jewelry piece includes first and second flat surfaces separated by a step surface that is perpendicular to both of the first and second flat surfaces, and forms step forms a step assembly. The first and second flat surfaces are magnetically attracted to first and second flat surfaces on either the other piece, or on the ornamental piece. The jewelry can be a necklace, in which case it can be a single ended necklace or a double-ended necklace, and it can be embodied into an earring, in which case it can be a single jewel earring, or can be an interchangeable jewel ending.

18 Claims, 4 Drawing Sheets

NECKLACE WITH INTERCHANGEABLE JEWEL PART

BACKGROUND

Jewelry such as necklaces are worn often to match to specific outfits or scenes to which the jewelry wearer feels is appropriate. For example, one set/color/style of jewelry might be used with a first color or style outfit while another set of jewelry might be used with a second color or style outfit. Likewise, different jewelry might be worn with different blouse or dress cuts such as scoop neck versus v-neck cuts appear best with different types of necklaces, such as a pendant or a drop necklace.

SUMMARY

The present application describes an item of jewelry, in one embodiment a claspless necklace, which both has an traditional pendant ornamental piece that separates into two end pieces, but also allows magnetically adding a new ornamental end piece. This allows the ornamental look of a pendant jewelry to be changed, between the one that is permanently attached to the jewelry, and a teardrop necklace that is interchangeable and can be added and removed by users. The ornamental ending can be changed, allowing the entire look of the jewelry to similarly be changed.

Techniques are described herein to ensure that the ornamental ending fits tightly to the necklace holder.

In one embodiment, the necklace has two parts which can be connected to one another, and can be disconnected, to expose a notched surface that has a magnetic connection and allows to insert two different ornamental notched endings on to the two different parts. When the two parts are disconnected, this exposes surfaces that allow interchangeable ornamental endings to be placed on the necklace.

In an embodiment, the single necklace can be visually worn in two different states: one Flat pendant or ornament and two drop down ornaments that also have interchangeable pieces of the same necklace.

Also, the tieing on of the necklace in the drop down version into an overhand knot and the simplicity of pulling the necklace off with no clasp, allows all ages and those with a various range of impairment to easily do the said necklace by themselves.

Embodiments use the inside magnet step version of both the necklace and endings having all positive sides of a magnet on the raised step and all negative magnets are on the lower step. This desin prohibits sliding and twisting of the disk so that the look of the pendant is consistent and stable. It also give a reference on the necklace of 45* for the loops and chain to be soldered so that it lays on the chest flat and correctly angled. The step also allows the reference of the loop to be soldered for the earrings at a perpendicular 90* angle from the step on the lower negative magnet

DETAILED DESCRIPTION

Figure 1:
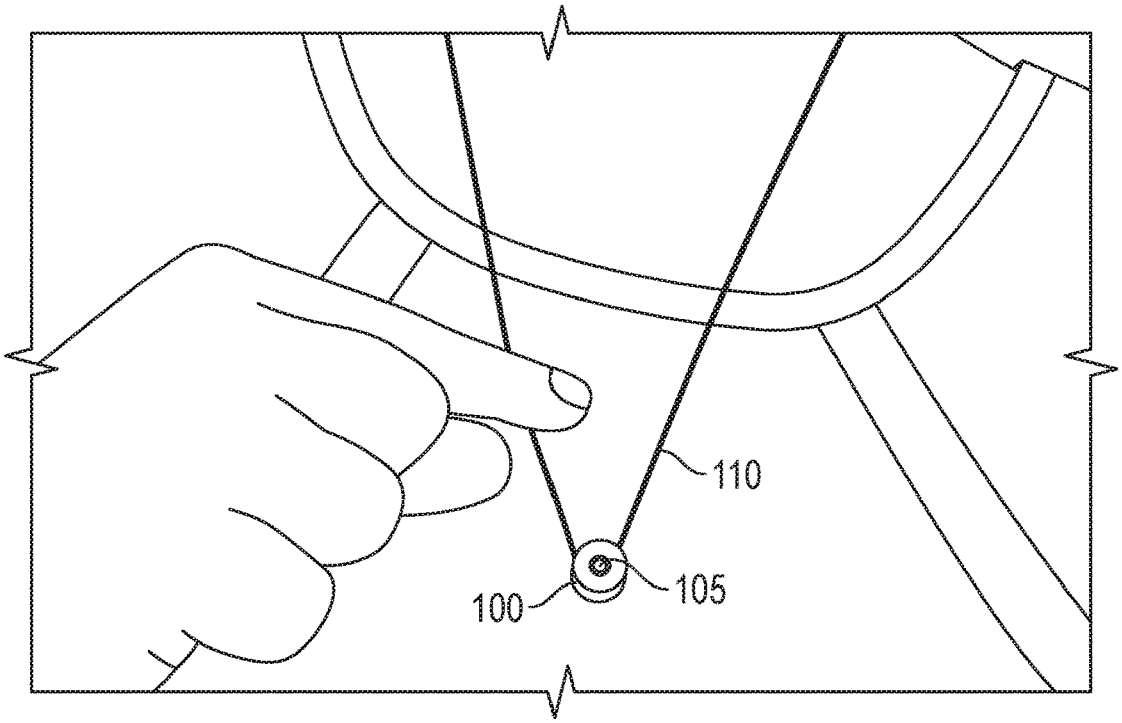
FIG. 1 shows a view of the necklace, in its basic configuration with the two parts attached to one another.

The basic necklace is shown in FIG. 1, which shows the necklace portion 100 on a chain 110. The necklace portion 100 is a special portion is described herein which can be separated into two distinct parts, and when separated, each surface exposes a magnetic surface that is adapted for magnetic attachment to hold a replaceable ornament.

Figure 2:
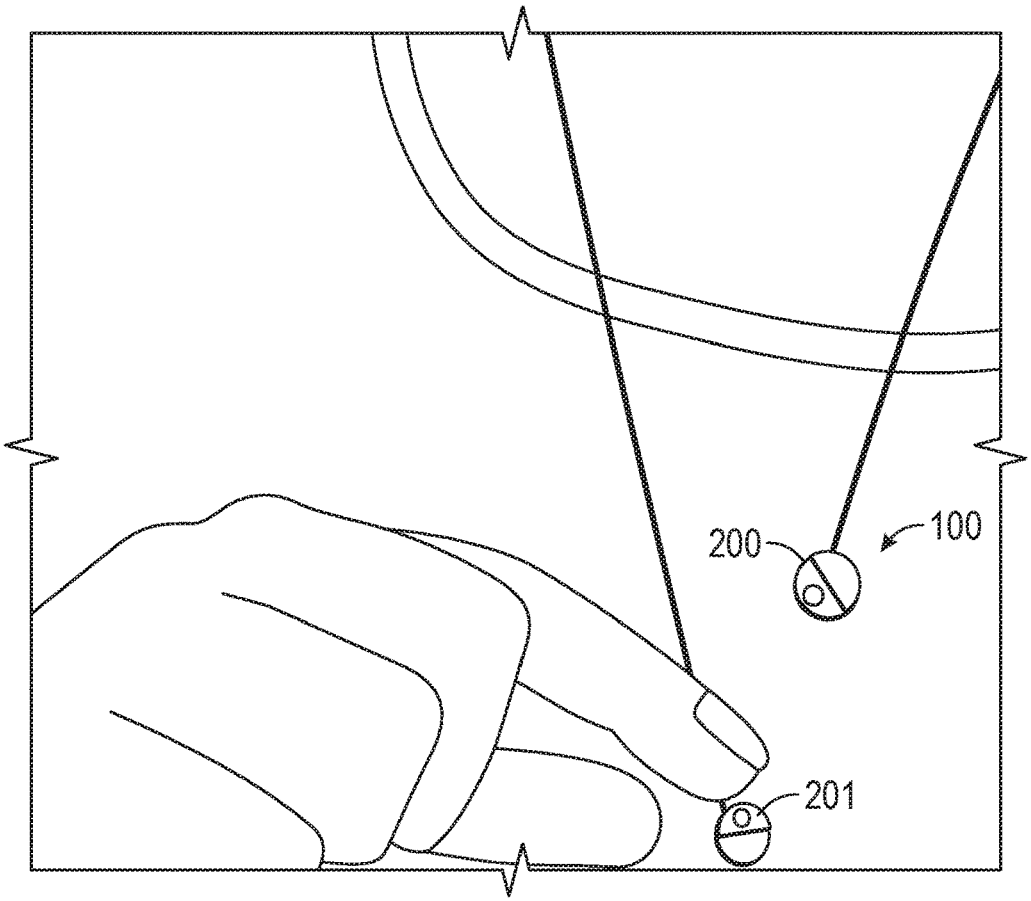
FIG. 2 shows the two parts of the necklace having been separated from one another.

FIG. 2 illustrates how the necklace portion 100 is separated into its two component parts 200 and 201, those two component parts being described herein. Those component parts 200 and 201 can have an ornamental and ending added to them once separated.

Figure 3:
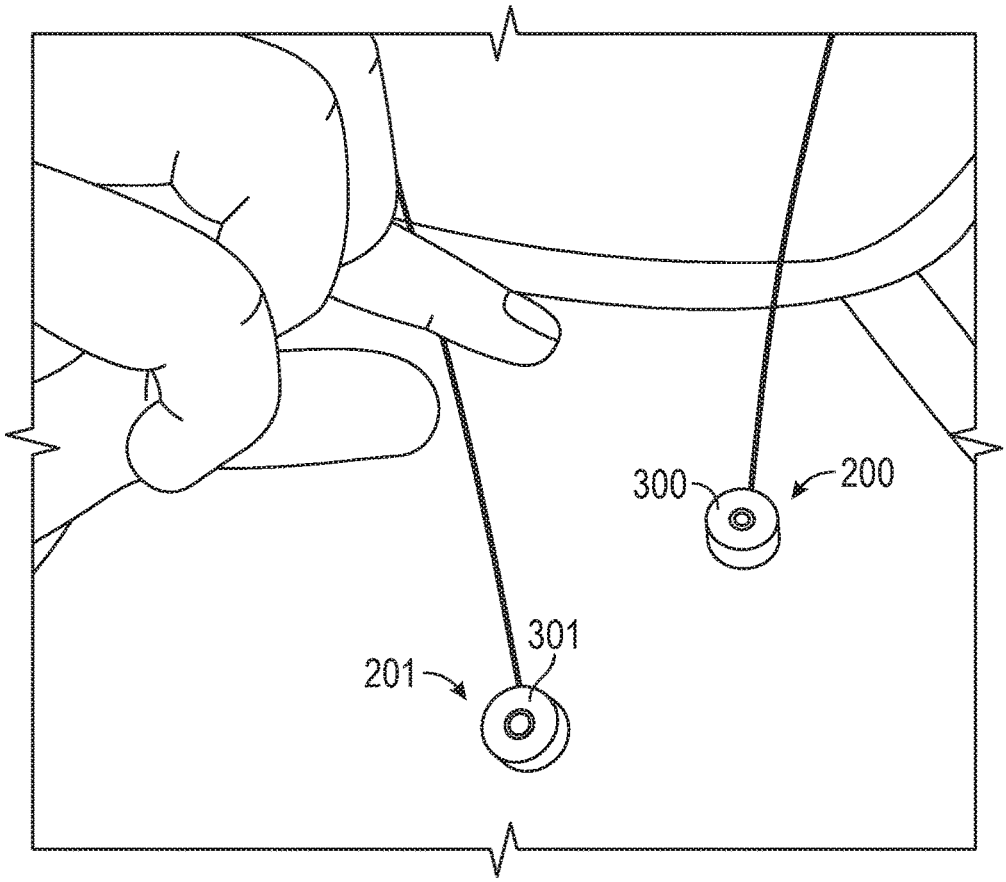
FIG. 3 shows the necklace with ornamental endings added onto each of the two parts.

In FIG. 3, the component part 200 is shown with an ornamental ending 300, and the component part 201 is shown with an ornamental ending 301.

In one embodiment, all of the parts can be 12 mm in diameter, with an embedded crystal therein. The crystal can be for example a diamond like crystal such as a Swarovski crystal.

Figure 4:
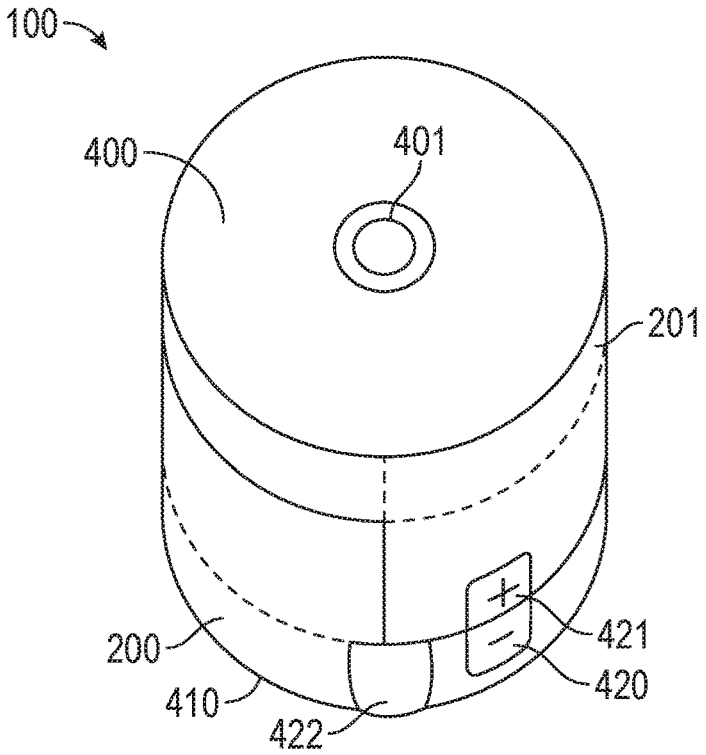
FIG. 4 shows a diagram of the main body of the necklace that is separated into the two parts.
Figure 5:
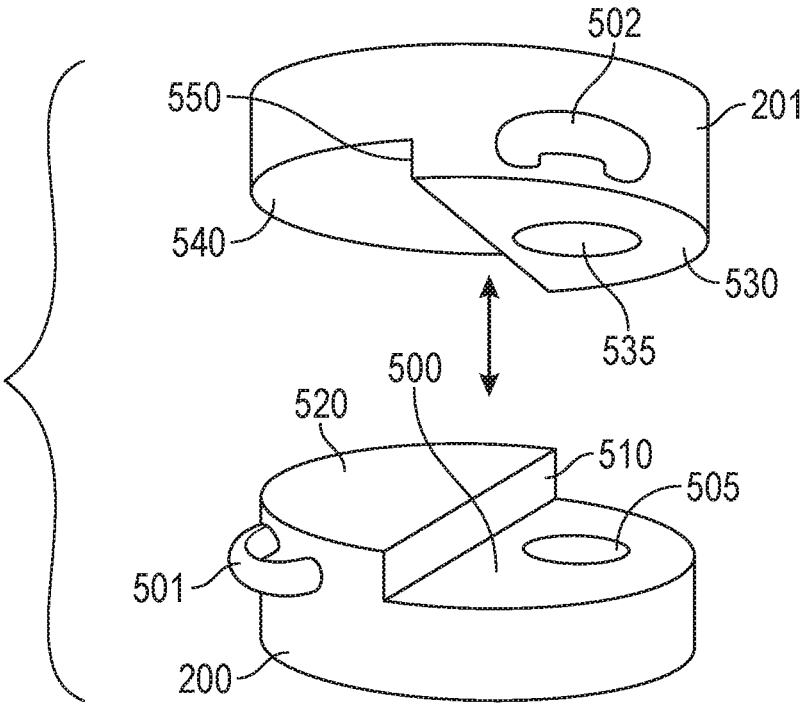
FIG. 5 shows a cutaway view of the two parts showing the different features and structures of those two parts.

FIG. 4 shows a detail of the ending 100. The ending 100 is formed of the two slide apart parts 200 and 201. Each of the slide apart parts includes, as shown in FIG. 5A, a first inner surface 500 which leads to a step surface 510 which is perpendicular to the first inner surface, and that leads to a second surface 520 at a different level/height from the first surface. The surfaces 500 and 520 are parallel to one another, but are spaced from one another by the distance of the step surface 510.

The first surface 500 includes a magnet 505 thereon. In this embodiment, the magnet has its negative magnetic pole facing upward.

In an analogous way, the second piece 201 is the mirror image of the first piece. The second piece 201 includes a first surface 530 which extends downward more than the second surface 540. There is also a step part 550 between the two surfaces 530 and 540, and the surface 530 includes a magnet 535 which has its positive pole facing towards the negative pole of the first magnet 505.

Both the parts also include loops to attach to a chain. A first loop 501 set at 45° angle from the step is on the first part 200 and a second loop 502 likewise is set at 45° angle from the step is on the second part. The chain fits through these loops 501, 502. When the two parts are fit together, they fit as in FIG. 4, to lay correctly on the chest of the wearer, with the first part 201 pressed against and magnetically coupled to the second part 201. In one embodiment, both surfaces, including the top surface 400 and the bottom surface 410 include crystals thereon, such as the crystal 401 and the crystal 402.

In an alternative embodiment, the entire device is made of a magnetic material, and there is a first magnet 420 in the first piece 200, which holds to the magnetic material (e.g., steel) in the second piece 201 that is adjacent to the first magnet 420. In a similar way, there is a second magnet 421 in the second piece 201 that holds to the material of the first piece 200. Both parts are mirror images of one another with the step with a perpendicular step surface extending between the two parallel but spaced surfaces. This provides for improved holding between the two parts.

In one embodiment, the necklace can be worn as shown in FIG. 1, with the ornament 105 in FIG. 1 facing outward and being the sole ornament. The user can separate the two parts as shown in FIG. 2, and add two endings shown in FIG. 3.

Figure 6:
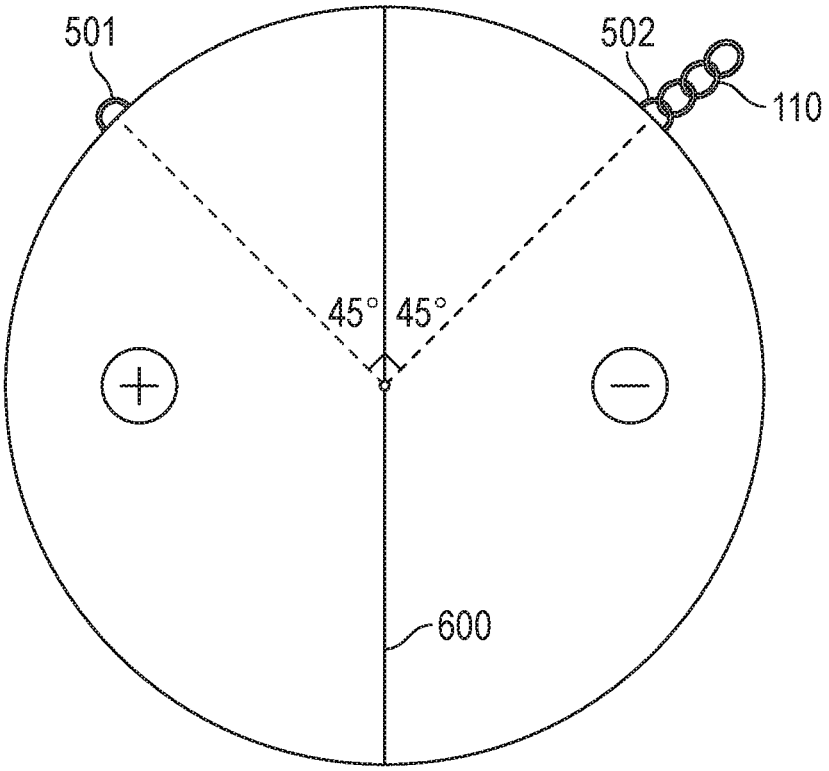
FIG. 6 shows locations for the different hooks to hold the chain.

In one embodiment, when the two parts are fit together, the loop such as 502 and 501 and 502 make 45° angles relative to the line 600 where the two step portions come together. The 45° angle of the loops as shown in FIG. 6 makes it so that the chain 110 can fit through the rear portion of the necklace. By putting the chain through the rear portion 502, this makes it so that the loop is less visible from the front view. In an embodiment, once the two different ornamentation parts have been inserted as shown in FIG. 3, those two parts can be knotted or otherwise attached, to hold them in place.

Another embodiment describes using this technique to form earrings with interchangeable and reversible jewel pieces. In this case, the connection to the jewel piece is a connection to an ear, rather than a connection to a chain.

Figure 7:
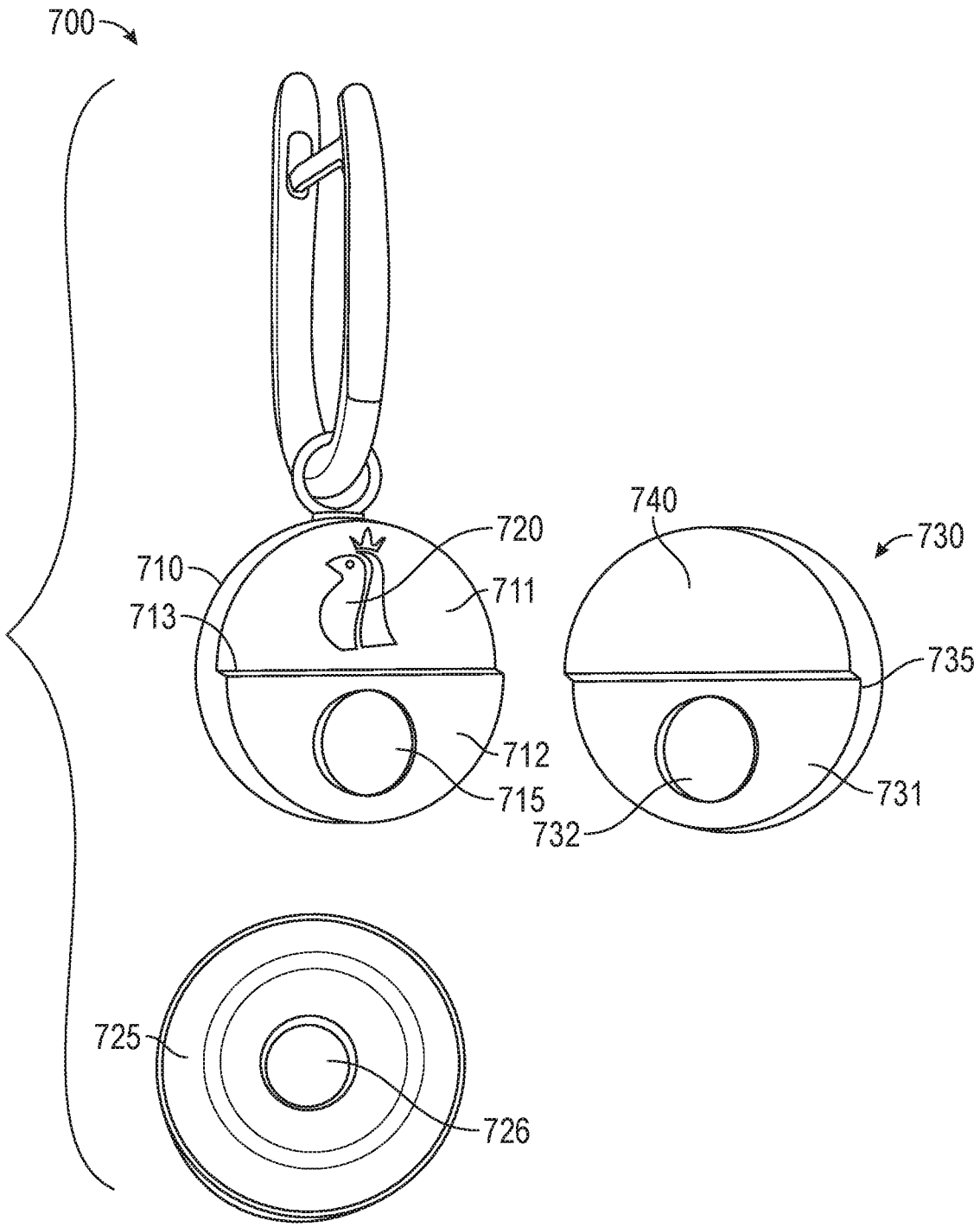
FIG. 7 shows these techniques applied to an earring embodiment.

FIG. 7 shows the earring 700, with its base portion 710. The front surface of the base portion includes a disc shaped surface, with a first flat surface 711, a second flat surface 712 that is raised up from the first flat surface 711, and a step surface 713 which extends at a right angle from between the first surface 711 and the second surface 712. A magnet 715 is recessed into the surface of the raised surface. There can be for example a laser etched logo 720 on the second surface.

The rear side of the base part 710 may be as shown in 725, with a jewel therein. The jewel can be of any form, and can be for example a crystal. There is also an ornamental ending shown as 730 which has a rear surface, having the mirror configuration to the surface of the base part 710. Specifically, there is a first recessed surface 731 with a recessed magnet 732 therein. The magnet 732 has the opposite polarity to the magnet 715. There is also a step surface 735 leading to a second raised surface 740 which fits against the raised surface 711. This allows use of the earring with either the first surface 725 showing, with its crystal 726, or the interchangeable ornamental surface of the ornamental ending showing.

In this way, the single necklace can be visually worn in two different states: one as a flat pendant or ornament and as two drop-down ornaments that also have interchangeable pieces of the same necklace.

The ease of function in comparison to other dainty chain necklaces with tiny clasps that are difficult or impossible to do: the tying on of the necklace in the drop down version into an overhand knot and the simplicity of pulling the necklace off with no clasp, allows all ages and those with a various range of impairment to easily do the said necklace by themselves.

The inside magnet step version of both the necklace and endings has magnets that are tested; all positive sides of a magnet are on the raised step and all negative magnets are on the lower step. This design avoids sliding and twisting of the disk so that the look of the pendant is consistent and stable. It also given a reference on the necklace of 45* for the loops and chain to be attached so that it lays on the chest flat and correctly angled. The step also allows the reference of the loop to be soldered for the earrings at a perpendicular 90° angle from the step on the lower magnet.

Although only a few embodiments have been disclosed in detail above, other embodiments are possible and the inventors intend these to be encompassed within this specification. The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A jewelry item comprising:

a main part, having at least one connection, and having first and second pieces which are connected to one another, the first piece having a perimeter surface extending around an entire edge of the first piece, an inside having a first surface which is substantially flat, a second surface which is also substantially flat and is parallel to the first surface, but is spaced therefrom by a first distance at a different level than the first surface, and a step surface, which extends between said first surface and said second surface, where the step surface is perpendicular to the first surface and to the second surface, the first surface, second surface, and step surface collectively forming a connection surface, and the first surface, second surface, and step surface collectively extending between the perimeter surface so that only the first surface, second surface, and step surface collectively exist within the perimeter surface, the first piece having an outside surface at an opposite side from the connection surface, having an ornamental jewel thereon, and the second piece having a perimeter surface extending around an entire edge of the second piece, an inside having a first surface which is substantially flat, a second surface which is also substantially flat and is parallel to the first surface, but is spaced therefrom by a first distance at a different level than the first surface, and a step surface, which extends between said first surface and said second surface, where the step surface is perpendicular to the first surface and to the second surface, the first surface, second surface, and step surface collectively forming a second connection surface, and the first surface, second surface, and step surface collectively extending between the perimeter surface so that only the first surface, second surface, and step surface collectively exist within the perimeter surface, the second connection surface fitting with the first connection surface, with the flat first surface of the first connection surface fitting with the flat second surface of the second connection surface and with the flat second surface of the first connection surface fitting with the flat first surface of the second connection surface, and with the step surface of the first connection surface fitting with the step surface of the second connection surface thus connecting the flat surfaces and step surfaces over an area covering an entirety of the perimeter surface, where the first connection surface and the second connection surface each include a magnetic part recessed into at least one of the surfaces, and where the first piece and the second piece are held to one another by their inside surfaces, held by the magnetic part.

2. The jewelry item as in claim 1, further comprising a first ornamental ending, which fits to said connection surface of the first piece, and has an inside surface that fits to the inside surface of the first piece, and has an outside surface which includes an ornamental jewel thereon, and a second ornamental ending which fits to said connection surface of the second piece, and has an inside surface that fits to the inside surface of the second piece, and has an outside surface which includes an ornamental jewel thereon.

3. The jewelry item as in claim 2, wherein the main part is substantially disc-shaped, having a round outer diameter, having a first and second oppositely facing ornamentation surfaces, and the inner surfaces having the first and second surfaces and the step surface extending therebetween.

4. The jewelry item as in claim 1, wherein the connection is to a chain, and the jewelry item is a necklace.

5. The jewelry item as in claim 4, further comprising first and second loops, each holding an end of the chain, said first and second loops being offset from one another by 90° when the first and second pieces are connected to one another where one of the loops is on the first piece, and the other of the loops is on the second piece.

6. The jewelry item as in claim 4, where the necklace has said first piece and said second piece which are connected to one another, and are disconnected, to expose said first and second connection surfaces each with a magnetic connection and first and second ornamental endings on to the first and second connection surfaces.

7. The jewelry item as in claim 1, wherein a first magnetic part on the first surface holds to a second magnetic part on the second surface.

8. The jewelry item as in claim 1, wherein a first magnetic part on the first connection surface holds to a magnetic material on the second connection surface and wherein a second magnetic part on the second connection surface holds to a magnetic material on the first connection surface.

9. A jewelry item comprising:

a main part, having at least one connection, and having first and second pieces which are connected to one another, the first piece having an inside having a first surface which is substantially flat, a second surface which is also substantially flat and is parallel to the first surface, but is spaced therefrom by a first distance at a different level than the first surface, and a step surface, which extends between said first surface and said second surface, where the step surface is perpendicular to the first surface and to the second surface, the first surface, second surface, and step surface collectively forming a connection surface, and the first piece having an outside surface at an opposite side from the connection surface, having an ornamental jewel thereon, and the second piece having an inside having a first surface which is substantially flat, a second surface which is also substantially flat and is parallel to the first surface, but is spaced therefrom by a first distance at a different level than the first surface, and a step surface, which extends between said first surface and said second surface, where the step surface is perpendicular to the first surface and to the second surface, the first surface, second surface, and step surface collectively forming a second connection surface, the second connection surface fitting with the first connection surface, where the first connection surface and the second connection surface each include a magnetic part recessed into at least one of the surface, and where the first piece and the second piece are held to one another by their inside surfaces, held by the magnetic part, where the jewelry item is an earring, and connects to an earring holder that goes into a user's ear.

10. The jewelry item as in claim 9, wherein the earring has an ornamentation side on a first side, and has the connection surface on a second side opposite to the first side.

11. A method of operating a jewelry item comprising:

connecting first and second pieces of a main part to one another, the first piece having an inside having a first surface which is substantially flat, a second surface which is also substantially flat and is parallel to the first surface, but is spaced therefrom by a first distance at a different level than the first surface, and a step surface, which extends between said first surface and said second surface, where the step surface is perpendicular to the first surface and to the second surface, the first surface, second surface, and step surface collectively forming a connection surface, and the first piece having an outside surface at an opposite side from the connection surface, having an ornamental jewel thereon, and the second piece having an inside having a first surface which is substantially flat, a second surface which is also substantially flat and is parallel to the first surface, but is spaced therefrom by a first distance at a different level than the first surface, and a step surface, which extends between said first surface and said second surface, where the step surface is perpendicular to the first surface and to the second surface, the first surface, second surface, and step surface collectively forming a second connection surface, the second connection surface fitting with the first connection surface, where the first connection surface and the second connection surface each include a magnetic part recessed into at least one of the surface, wherein said connecting uses said magnetic part to hold between the connection surfaces;

and disconnecting the first connection surface and the second connection surface and exposing said first and second connection surfaces each with a magnetic connection, and attaching a first ornamental ending, which fits to said connection surface of the first piece, and has an inside surface that fits to the inside surface of the first piece, and has an outside surface which includes an ornamental jewel thereon, and attaching a second ornamental ending which fits to said connection surface of the second piece, and has an inside surface that fits to the inside surface of the second piece, and has an outside surface which includes an ornamental jewel thereon, wherein the first piece having a perimeter surface extending around an entire edge of the first piece, the first surface, second surface, and step surface of the first piece collectively extending between the perimeter surface so that only the first surface, second surface, and step surface collectively exist within the perimeter surface and the second piece having a perimeter surface extending around an entire edge of the second piece, and the first surface, second surface, and step surface of the second piece collectively extending between the perimeter surface so that only the first surface, second surface, and step surface collectively exist within the perimeter surface, and the second connection surface fitting with the first connection surface, with the flat first surface of the first connection surface fitting with the flat second surface of the second connection surface and with the flat second surface of the first connection surface fitting with the flat first surface of the second connection surface, and with the step surface of the first connection surface fitting with the step surface of the second connection surface thus connecting the flat surfaces and step surfaces over an area covering an entirety of the perimeter surface.

12. The method as in claim 11, wherein the main part is substantially disc-shaped, having a round outer diameter, having a first and second oppositely facing ornamentation surfaces, and inner surfaces having the first and second surfaces and the step surface extending therebetween.

13. The method as in claim 11, wherein the connection is to a chain, and the jewelry item is a necklace.

14. The method as in claim 13, further comprising first and second loops, each holding an end of the chain, said first and second loops being offset from one another by 90° when the first and second pieces are connected to one another where one of the loops is on the first piece, and the other of the loops is on the second piece.

15. The method as in claim 11, the jewelry item is an earring, and connects to an earring holder that goes into a user's ear.

16. The method as in claim 15, wherein the earring has an ornamentation side on a first side, and has the connection surface on a second side opposite to the first side.

17. The method as in claim 11, wherein the connection between connection surfaces is between two opposite pole magnets.

18. The method as in claim 11, wherein the connection between connection surfaces is between a magnet and a surface that holds to the magnet.

* * * * *